US010401096B2

(12) United States Patent
Kalsi

(10) Patent No.: US 10,401,096 B2
(45) Date of Patent: Sep. 3, 2019

(54) HEAT EXCHANGER

(71) Applicants: Energy Technologies Institute LLP, Loughborough, Leicestershire (GB); Kamaldeep Kalsi, Cambridge, Cambridgeshire (GB)

(72) Inventor: Kamaldeep Kalsi, Cambridge (GB)

(73) Assignees: ENERGY TECHNOLOGIES INSTITUTE LLP, Leicestershire (GB); KAMALDEEP KALSI, Birmingham (GB)

( * ) Notice: Subject to any disclaimer, the term of this patent is extended or adjusted under 35 U.S.C. 154(b) by 0 days.

(21) Appl. No.: 15/345,351

(22) Filed: Nov. 7, 2016

(65) Prior Publication Data

US 2017/0350660 A1 Dec. 7, 2017

(30) Foreign Application Priority Data

Jun. 6, 2016 (GB) ..... 1609847.7

(51) Int. Cl.
*F28F 9/02* (2006.01)
*F28F 7/02* (2006.01)
(Continued)

(52) U.S. Cl.
CPC ..... *F28F 9/0214* (2013.01); *F28F 7/02* (2013.01); *F28F 9/0268* (2013.01); *F28F 21/04* (2013.01);
(Continued)

(58) Field of Classification Search
CPC ..... F28D 9/0068; F28D 9/0093; F28F 7/02; F28F 21/04
See application file for complete search history.

(56) References Cited

U.S. PATENT DOCUMENTS 2,821,369 A * 1/1958 Hilliard ..... F28F 7/02 165/145
3,272,260 A 9/1966 Raub et al.
(Continued)

FOREIGN PATENT DOCUMENTS

EP 0 287 449 A1 10/1988
FR 2 486 222 A1 1/1982
(Continued)

OTHER PUBLICATIONS

Search Report issued in corresponding Great Britain application, dated Aug. 2, 2016.
(Continued)

*Primary Examiner* — Eric S Ruppert
(74) *Attorney, Agent, or Firm* — Hamre, Schumann, Mueller & Larson, P.C.

(57) ABSTRACT

The present invention relates generally to a manifold for a parallel flow heat exchanger and a heat exchanger incorporating that manifold. The manifold comprising a first plurality of channels each having a first opening facing a first direction and a second opening facing a second direction different from the first direction. The manifold further comprises a second plurality of channels interleaved with the first plurality of channels, the second plurality of channels having a third opening facing a third direction and a fourth opening facing the first direction, wherein the third direction is different from the first direction and the second direction.

13 Claims, 7 Drawing Sheets

(51) Int. Cl.
*F28F 21/04* (2006.01)
*F28D 9/00* (2006.01)

(52) U.S. Cl.
CPC .... *F28D 9/0093* (2013.01); *F28F 2009/0287* (2013.01); *F28F 2230/00* (2013.01); *F28F 2250/104* (2013.01); *F28F 2255/18* (2013.01)

(56) References Cited

U.S. PATENT DOCUMENTS 3,517,733 A * 6/1970 Tasker ..... F28D 9/0068 165/166
4,050,506 A 9/1977 Small
4,298,059 A * 11/1981 Krauth ..... F28F 21/04 165/166
5,324,452 A * 6/1994 Allam ..... B01J 19/0013 165/166
2004/0261379 A1* 12/2004 Bruun ..... F23C 13/00 55/418
2011/0129640 A1* 6/2011 Beall ..... B28B 1/001 428/116

FOREIGN PATENT DOCUMENTS

JP 6-34283 A 2/1994
JP 10253286 * 9/1998
WO 94/10520 A1 5/1994
WO 03/033985 A1 4/2003
WO 2004/090451 A1 10/2004
WO 2004/094909 A1 11/2004
WO 2008/019117 A2 2/2008

OTHER PUBLICATIONS

International Search Report issued in counterpart application No. PCT/GB2017/051571, Sep. 18, 2017 (7 pages).

* cited by examiner

HEAT EXCHANGER

FIELD OF DISCLOSURE

The present invention relates to a manifold for a parallel flow heat exchanger and a heat exchanger including said manifold.

BACKGROUND

Heat exchangers are used in many systems, from cars to air-conditioning units to energy recovery devices in advanced thermal treatment systems.

Conventionally, the design of heat exchangers has to take into account various factors. For example, fouling may cause increased pressure drop and reduced heat transfer rate which can have a detrimental effect on heat exchanger efficiency. As another consideration, heat exchangers by their nature will experience temperature variation. In addition, heat exchangers may be subject to high velocity fluid (gas or liquid) flows with particulate loading that elevates wear rates for certain areas of the system. Erosion problems can be exacerbated when a heat exchanger operates at an elevated temperature. Similarly, fluids passing through a heat exchanger may contain acids or other corrosive materials, which may even degrade the interior of a heat exchanger more at elevated temperatures. Corrosion and erosion problems may be particularly prevalent in metallic heat exchangers In some conventional ceramic heat exchangers, a tube-to-tubesheet construction is employed. A first fluid flows inside a series of tubes while a second fluid flows over the outside of the tubes. On contact with the tubes, therefore, the second fluid can stagnate, which can lead to a number of problems. For example, if the second fluid contains particulates, the surface of the tubes normal to the flow of the second fluid will experience increased erosion. Also, in some situations, the stagnation points around the tubes will lead to fouling.

There is a need for methods and apparatus that allow efficient heat exchange between fluids.

Means for Solving the Problem

The present invention relates to a manifold for a parallel flow heat exchanger and a heat exchanger comprising that manifold.

In an aspect, a manifold for a parallel flow heat exchanger comprises a first plurality of channels each having an opening facing a first direction and an opening facing a second direction different from the first direction; and a second plurality of channels interleaved with the first plurality of channels, the second plurality of channels having an opening facing a third direction and an opening facing the first direction, wherein the third direction is different from the first direction and the second direction.

Advantageously, with a parallel flow heat exchanger, fluids can flow parallel or anti parallel with each other (i.e. counter flow concurrent). In turn, this reduces the chances of stagnation of a fluid within the heat exchanger. In an example where a first fluid travels through a series of pipes, and a second fluid flows orthogonally around the outside of those pipes, the second fluid will stagnate at the point of contact with the pipes and experience turbulent effect on the other side of those pipes. The pressure drop caused by the stagnation/turbulence can lead to inefficiency in the heat transfer between the first and second fluid.

Additionally, even if the first and second fluids were caused to flow through orthogonal channels, the heat exchanger would have to be expanded in two dimensions (length and width) to increase the heat transfer area. This, in turn, will reduce the pressure for a given volume of fluid due to the larger width of the heat exchanger (and therefore the larger cross sectional area of the channels). Hence, the velocity of fluids travelling through the heat exchanger will also be reduced for that given volume of fluid. With a parallel flow, on the other hand, the heat exchanger can be expanded in one dimension (i.e. the increasing the length while leaving the width the same) to increase the heat transfer area. The other dimensions (i.e. the width and height) can remain the same therefore minimising the effect on the pressure and velocity.

In some aspects, the manifold is adapted to operate at a temperature of between 1,070° C. and 1350° C. In this manner, the range of fluids and temperature variations that can be processed by the heat exchanger increases.

In some aspects, the manifold is Silicon Carbide or a Silicon Carbide derivative material. Silicon Carbide, or a Silicon Carbide derivative material, allows the manifold to be more erosion and corrosion resistant while also allowing the manifold to process fluid at high temperatures.

In some aspects, a manifold further comprises a third plurality of channels having an opening facing a fourth direction and an opening facing the first direction, wherein the fourth direction is different from the first direction, the second direction, and the third direction. In this manner, a manifold is able to cause fluid from three different fluid sources to flow parallel inside a heat exchanger. If the three fluids are at different temperatures, this provides greater control over the temperature of fluids exiting the heat exchanger.

In some aspects, a predetermined number of interleaved channels from each of the first and second set of channels are disposed between consecutive channels from the third set of channels. Preferably, the predetermined number is greater than one.

In some aspects, a manifold still further comprises a fourth plurality of channels having an opening facing a fifth direction and an opening facing the first direction, wherein the fifth direction is different from the first direction, the second direction, the third direction, and the fourth direction. Such an arrangement provides even greater control over the temperature of a first and second fluid exiting a heat exchanger. For example, with fluid from four fluid sources, a first and second fluid may be provided to be processed (i.e. to have the temperature increased/decreased), whereas the third and fourth fluids may be provided to modulate the temperature of the first and second fluids. In some examples, the third fluid may be a coolant and the fourth fluid may be a heating fluid.

The present invention further comprises a method of manufacturing the manifold as described herein, wherein said manufacturing comprises 3D printing said manifold.

In some aspects, a heat exchanger comprises two manifolds connected to opposed sides of a heat exchange stack, wherein each manifold is a manifold as herein described, and the heat exchange stack comprises at least one heat exchange block, having a plurality of channels therethrough, the channels of the heat exchange block aligning with the channels of each manifold to form a series of gas paths encompassing both manifolds and the heat exchange stack.

In some aspects, heat exchange blocks include an inset area adapted to receive a gasket, said inset area being disposed on a surface of the block and surrounding the channels on the surface of the block. Such an arrangement reduces the possibility of cross contamination of fluids within the heat exchanger.

In some aspects, a first fluid path comprises the first plurality of channels in one manifold and the first plurality of channels in the other manifold and a second fluid path comprises the second plurality of channels in one manifold and the second plurality of channels in the other manifold. A heat exchanger of these aspects further comprises a first connector adapted to connect the first fluid path to a first fluid source; and a second connector adapted to connect the second fluid path to a second fluid source.

In some aspects, the heat exchanger still further comprises a third connector to connect the first fluid path to the second fluid source at an end of the first fluid path opposed to the first connector. A fluid entering the heat exchanger as the first fluid can therefore be used to exchange heat with the same fluid that has been thermally processed and then re-entered into the heat exchanger as the second fluid.

In some aspects, the first and second connectors are attached to the same manifold. In other aspects, the first and second connectors are attached to the different manifolds.

Various embodiments and aspects of the present invention are described without limitation below, with reference to the accompanying figures.

DETAILED DESCRIPTION OF A PREFERRED EMBODIMENT

The present invention relates to a manifold 2 for a heat exchanger 1, and a heat exchanger 1 incorporating said manifold 2. Within the heat exchanger 1, fluids from two different fluid sources flow to each other through interleaved, isolated, parallel channels. The heat exchanger 1 is of particular use in Advanced Thermal Treatment systems, but can be applied to other fields, such as high temperature flue gas heat recovery, high temperature process fluid energy recovery, aggressive chemical fluid energy recovery, chemical reactor economization, carbon black production processes, high temperature Ericsson cycle (indirectly fired Joule cycle), high temperature recovery of hot, chemically aggressive, fouling gases e.g. steel industry, and petrochemical applications. Those fields are provided as examples, and application of heat exchanger 1 is not limited to those fields.

Figure 1:
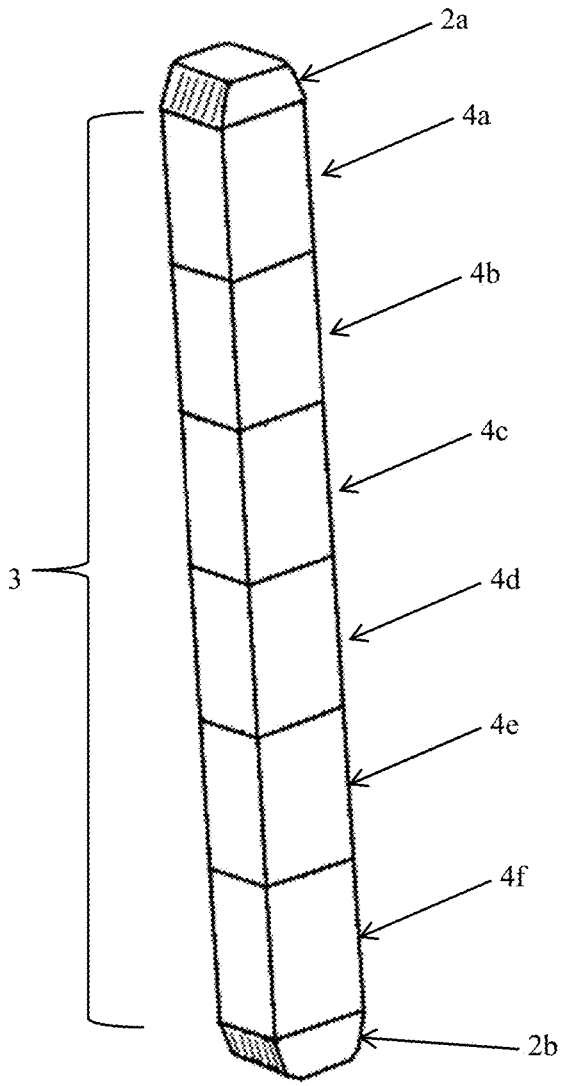
FIG. 1 depicts a perspective view of a heat exchanger.

In a preferred embodiment, the heat exchanger 1 consists of a first manifold 2*a* connected to a heat exchange stack 3, which is itself also connected to a second manifold 2*b*. The heat exchange stack 3 comprises at least one heat exchange block 4. The first and second manifolds 2*a*, 2*b* of the heat exchanger 1 are substantially the same in design but will have different orientations when connected to the heat exchange stack 3, as shown in FIG. 1.

Manifold

Figure 2:
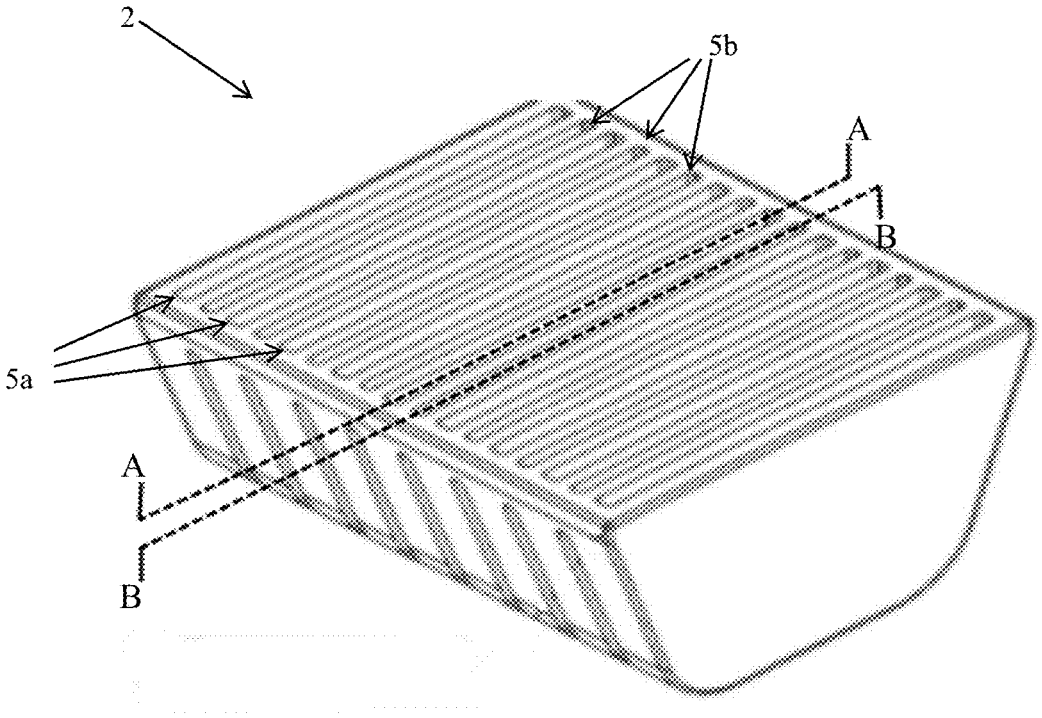
FIG. 2 depicts a perspective view of a manifold for a heat exchanger.

With reference to FIG. 2, a manifold 2 consists of interleaved channels 5 that allow two fluid streams to enter or exit from different directions, while the flow of both two fluid streams at one entrance/exit of the manifold 2 will be along the same axis. The arrangement shown in FIG. 2 has a trapezoidal cross-section, an entrance/exit of a first fluid stream is located on one non-parallel side of the trapezium whereas an entrance/exit of the second fluid stream is located on the other one non-parallel side of the trapezium. Manifold 2 of FIG. 2 is intended to be attached to a heat exchanger stack 3 at the longer parallel side of the trapezium. With this arrangement, the faces associated with the non-parallel sides will have half the number of channels as the face to be attached to a heat exchanger stack 3. A manifold 2 can therefore distribute the flow of fluid into and out of the heat exchanger stack 3 in a parallel manner. Other cross-sectional shapes are possible, and the present invention is not limited to trapezoidal cross-sections for the manifold.

The manifold 2 includes two sets of channels 5*a*, 5*b* with all channels 5, 5*a*, 5*b* having an opening in a first direction (i.e. toward a heat exchange stack). A first set of channels 5*a* has another opening facing a second direction (i.e. to the left in FIG. 2) and the second set of channels 5*b* has another opening in a third direction (i.e. to the right in FIG. 2). The second and third directions are different from each other. Preferably both the second and third directions are also different from the first direction, but the manifold requires only one of the second and third directions to differ from the first direction. Each channel 5 in the first and second sets of channels 5*a*, 5*b* therefore creates an enclosed volume through which a fluid (gas or liquid) may travel. Within the manifold having this design, a fluid in one channel is isolated from a fluid in any of the other channels.

The above arrangement allows a first (heated) fluid from a first location to flow to enter or exit the first plurality of channels 5*a* from a different source than the fluid entering or exiting the second plurality of channels 5*b*. When the manifold 2 is attached to a heat exchanger stack 3, the fluid path encompassing the first plurality of channels 5*a* will be parallel to the fluid path encompassing the second plurality of channels 5*b* inside the heat exchanger stack 3. The manifold 2 therefore allows fluid from different sources to be made to flow parallel within a heat exchanger stack 3.

The first plurality of channels 5*a* and the second plurality of channels 5*b* are interleaved to allow fluid from different fluid sources to flow in alternate channels 5 within the manifold 2. For example, a first channel of the first plurality of channels 5*a* is disposed next to a first channel of the second plurality channels 5*b*, which also disposed next to a second channel of the first plurality of channels 5*a*. The second channel of the first plurality of channels 5*a* is then also disposed next to a second channel of the second plurality of channels 5*b* and so forth. When a first fluid (for example, a relatively hot fluid) flows in the first plurality of channels 5*a* and a second fluid (for example, a relatively cool fluid) flows in the second plurality of channels 5*b*, heat exchange between the first and the second fluids will occur in the manifold 2.

It is also preferred that the geometry of the channels of the first and second plurality of channels 5*a*, 5*b* is such that flow velocity can be maintained consistently high throughout the heat exchanger 1. Each channel consists of a gentle curvature that takes a flow and turns it in a manner that allows alternate hot and cold streams to be channelled into the core heat exchanger stack 3. In the arrangement shown in FIGS. 3 and 4, for example, there is no point along a heat transfer surface (i.e. a wall of the channel) that is at right angles (90°) to the direction of fluid flow. This prevents stagnation of fluid within the manifold 2, thereby allowing a high flow velocity and significantly reducing fouling propensity.

Figure 5:
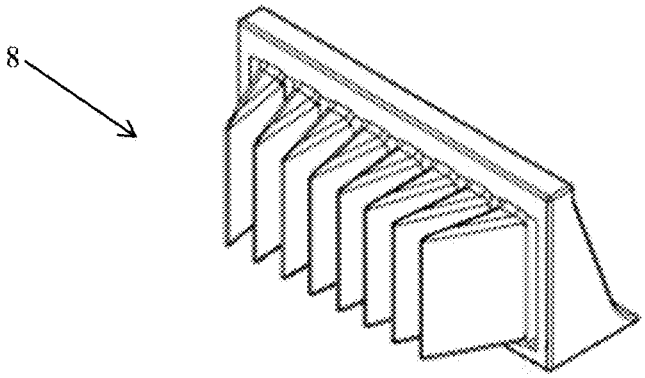
FIG. 5 depicts a perspective view of a diffuser for a manifold.
Figure 6:
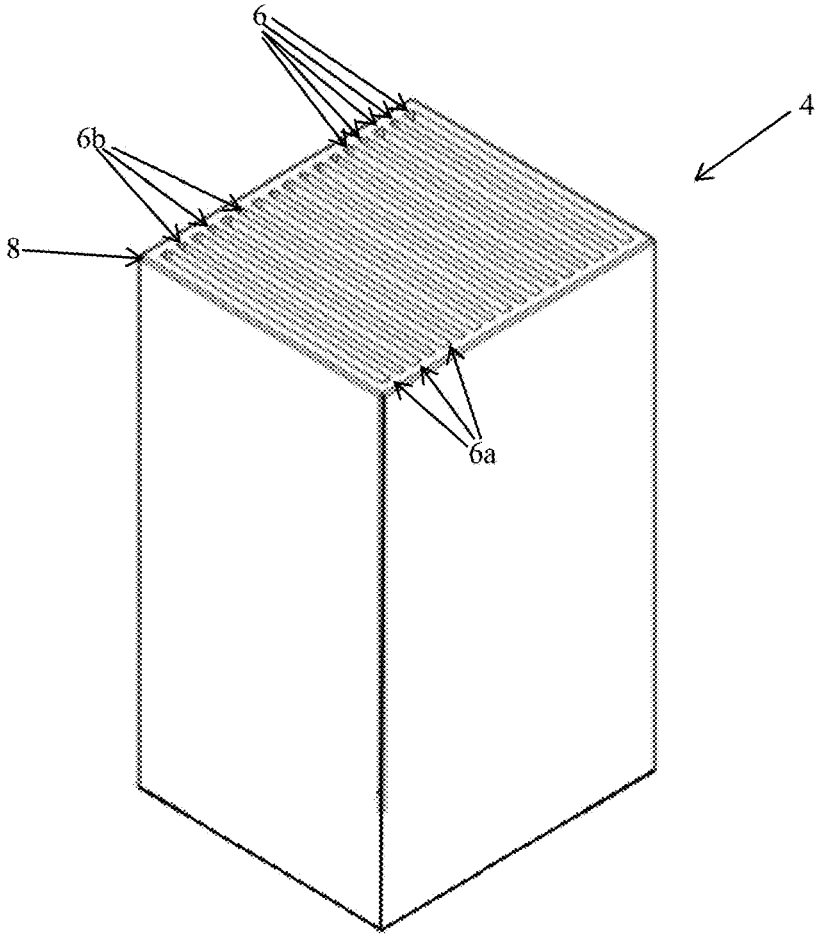
FIG. 6 depicts a perspective view of a heat exchanger block for a heat exchanger.

To further minimise the chance of stagnation, and to maintain a high flow velocity, the entry to the manifold for a fluid may include a set of diffusers 8 to channel the flow appropriately. Such a diffuser 8 can be seen in FIG. 5.

It is preferred that the manifold 2 is 3D printed and then fired for curing for ease of manufacture. This method of construction is cost effective, as the assembly process is straightforward refractory based work, not requiring specialist welding or other such skill.

The preferred manifold 2 is manufactured from Silicon Carbide (SiC). The preferred manifold is therefore manufactured from SiC or a SiC derived material, although other materials and construction techniques can be applied. The high temperature resistance of the SiC material allows the manifold 2 to be operated continuously in highly corrosive and aggressive environments at up to 1350° C. By changing the variants of the SiC this can be increased to 1600° C.

Figure 3:
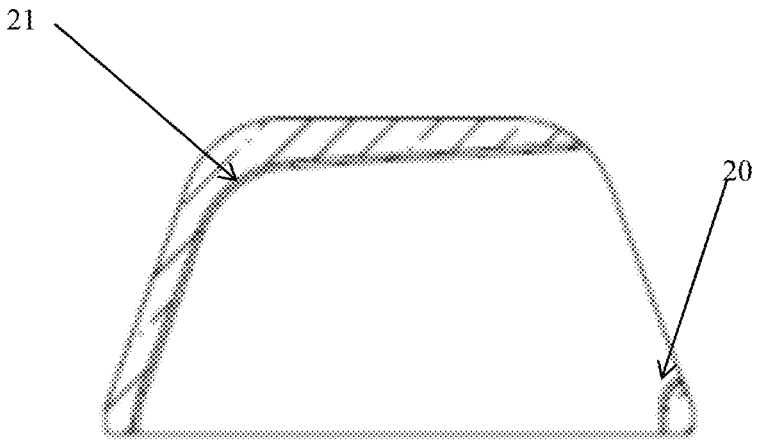
FIG. 3 depicts a cross sectional view along line A-A of FIG. 2.
Figure 4:
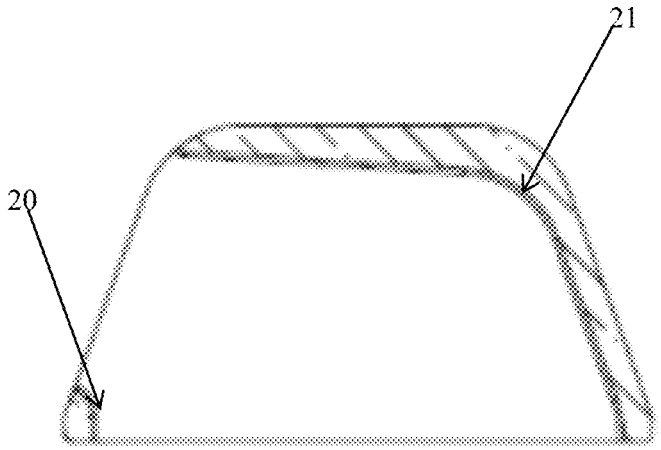
FIG. 4 depicts a cross sectional view along line B-B of FIG. 2.

Two opposite corners 20, 21 may be defined in a manifold 2 such that, when viewing a cross-section of the channel in the manifold 2, two sides adjacent a first corner 20 have openings thereon and two sides adjacent a second corner 21 are absent openings as shown in FIGS. 3 and 4, which show cross-sections taken along lines A-A and B-B of FIG. 2 respectively. FIG. 3 therefore shows one of the first set of channels 5*a* and FIG. 4 shows one of the second set of channels 5*b*. A radius of curvature at the second corner 21 is chosen to avoid stagnation of fluid flowing through the channel. In some aspects, that radius of curvature is between 95 mm and 125 mm. In a preferred aspect, the radius of curvature is 110 mm. It will be apparent, however, that different a radius of curvature can be applied depending on a number of factors, including the intended fluid to pass through the manifold.

Heat Exchanger Stack

The heat exchanger stack 3 comprises one or more heat exchanger blocks 4. Each heat exchanger block 4 has a number of parallel channels 6 through which fluid can flow. In the preferred embodiment a heat exchanger block 4 is a cuboid, with each channel 6 having a rectangular cross section and extending along an axis of the cuboid from one face to the opposite face of said cuboid. The channels 6 in the heat exchange block 4 therefore will be parallel with each other. This ensures that heat exchange between fluids in adjacent channels 6 takes place along the entire channel 6 without the need to create a complicated or overly large heat exchanger 1. Each channel in the heat exchange block 4 therefore creates an enclosed volume through which a fluid (gas or liquid) may travel. Within a heat exchange block 4 as described herein, a fluid in one channel 6 is isolated from a fluid in any of the other channels 6.

The top and bottom of a heat exchange block 4 has inset areas 8 that enable gasket tight sealing between the heat exchange block 4 and a manifold 2 or another heat exchange block 4. It will be apparent that a manifold 2 can also include similar inset areas in some embodiments. The inset areas 8 are on the surface of the heat exchange block 4 and are located such that a gasket placed in the inset area 8 surrounds the channels 6 when the heat exchange block 4 is combined with manifolds 2 and/or heat exchange blocks 4 in a heat exchanger 1. In a preferred arrangement, ceramic fibre gasketing is utilised, which is permitted by the simplicity of the geometry of the heat exchange blocks and manifolds at the connection between those elements.

It is preferred that heat exchange blocks 4 produced using slip casting. In other embodiments, the heat exchange blocks 4 are 3D printed and then fired for curing. A preferred heat exchange block 4 is manufactured from Silicon Carbide (SiC). Other materials and construction techniques can be applied. In still other embodiments, the heat exchange blocks 4 may be constructed by assembling unfired, or 'green', ceramic plates that are then cured as an ensemble. Other manufacturing techniques are also possible.

Heat Exchanger

In the arrangement shown in FIG. 1, a heat exchanger 1 includes two manifolds 2*a*, 2*b* and a heat exchange stack (also termed a heat exchange core) 3, with the manifolds 2*a*, 2*b* being attached to opposed ends of the heat exchange stack 3. In the arrangement of FIG. 1, six heat exchange blocks 4*a*, 4*b*, 4*c*, 4*d*, 4*e*, 4*f* are shown, although it will be apparent that the number of heat exchange blocks 4 can vary depending on the requirements of the system in which the heat exchanger 1 is employed. The heat exchanger 1 further includes connectors to connect the manifolds to respective fluid sources. For example, a first connector associated with a first fluid path connects the first manifold 2*a* to a first fluid source, and a second connector associated with a second fluid path connects the second manifold 2*b* to a second fluid source. In some aspects, a third connector associated with the second fluid path also connects the second manifold 2*b* to the second fluid source.

Each element of the heat exchanger (i.e. the manifolds 2*a*, 2*b* and the heat exchange blocks 4*a*, 4*b*, 4*c*, 4*d*, 4*e*, 4*f*) is combined together along an axis of the heat exchanger 1. That axis of the heat exchanger 1 therefore passes through the heat exchanger stack 3 and through both manifolds 2*a*, 2*b*, which are disposed at opposed ends of the heat exchanger stack 3. Using the orientation of a manifold 2 as described earlier, the first direction of each manifold 2*a*, 2*b* is aligned with the axis of the heat exchanger 1, although one manifold is inverted in relation to the other (i.e. the face having the most openings on each manifold faces the other manifold).

The first set of channels 5*a* in the first manifold 2*a* align with a first set of channels 6*a* in the heat exchange stack 3, which themselves align with a first set of channels 5*a* in the second manifold 2*b* to create a first set of fluid paths. Similarly, the second set of channels 5*b* in the first manifold 2*a* align with a second set of channels 6*b* in the heat exchange stack 3, which themselves align with a second set of channels 5*b* in the second manifold 2*b* to create a second set of fluid paths. The first and second fluid paths will therefore be interleaved. For example, a first fluid path of the first set of fluid paths is adjacent to a first fluid path of the second set of fluid paths, which is also adjacent to a second fluid path of the first set of fluid paths. The second fluid path of the second set of fluid paths is then also adjacent to a second fluid path of the second set of fluid paths and so on.

The fluid paths, when within the heat exchange stack 3, are parallel with the axis of the heat exchanger 1. In each manifold 2*a*, 2*b*, the fluid paths turn from being parallel with the axis to a different direction; the first set of fluid paths turn to face one direction that isn't parallel with the axis whereas a second set of fluid paths turn to face another direction that isn't parallel with the axis and is different from the direction of the first set of fluid paths.

In this way, the manifolds 2*a*, 2*b* are able to separate fluid in the first set of fluid paths from fluid in the second set of fluid paths. This allows the heat exchanger 1 to have fluids input from two different fluid sources. As the first and second sets of fluid paths are interleaved, the manifolds 2*a*, 2*b* separate the fluids into respective fluid paths and cause the fluids to flow in adjacent channels within the heat exchange stack 3. Heat exchange between the fluids can then occur using the material of the manifolds 2 and heat exchange blocks 4 as a heat exchange medium.

In some embodiments, fluid in both the first and second sets of fluid paths flows in the same direction. In other embodiments, fluid in the first set of paths flows in the opposite direction to fluid in the second set of fluid paths.

As a result of parallel flow of the fluid in the above described heat stack 3, the area of the heat exchanger 1 over which heat exchange takes place between fluids in adjacent channels 6 is maximised, thereby providing a more efficient heat exchanger. Further, the heat exchanger 1 need only be expanded along a single axis in the event that the heat exchange surface needs to be altered (for example, if additional time for heat exchange between the two fluids is required). In this regard, the modular nature of the heat exchanger blocks 4 and manifolds 2 enhances the advantage as the length of the heat exchanger 1 can be altered by increasing or reducing the number of heat exchange blocks 4 in a quick and simple manner. Further, such a modular arrangement is advantageous in that if one element is damaged it can simply and quickly be removed and replaced, thereby minimising the down-time of a system incorporating the heat exchanger. With typical metallic heat exchangers, components are welded together, thus precluding a simple mechanism to remove and replace a damaged component. Welding also makes access to the interior of the heat exchanger more difficult, which may increase down-time if cleaning is required.

Figure 7:
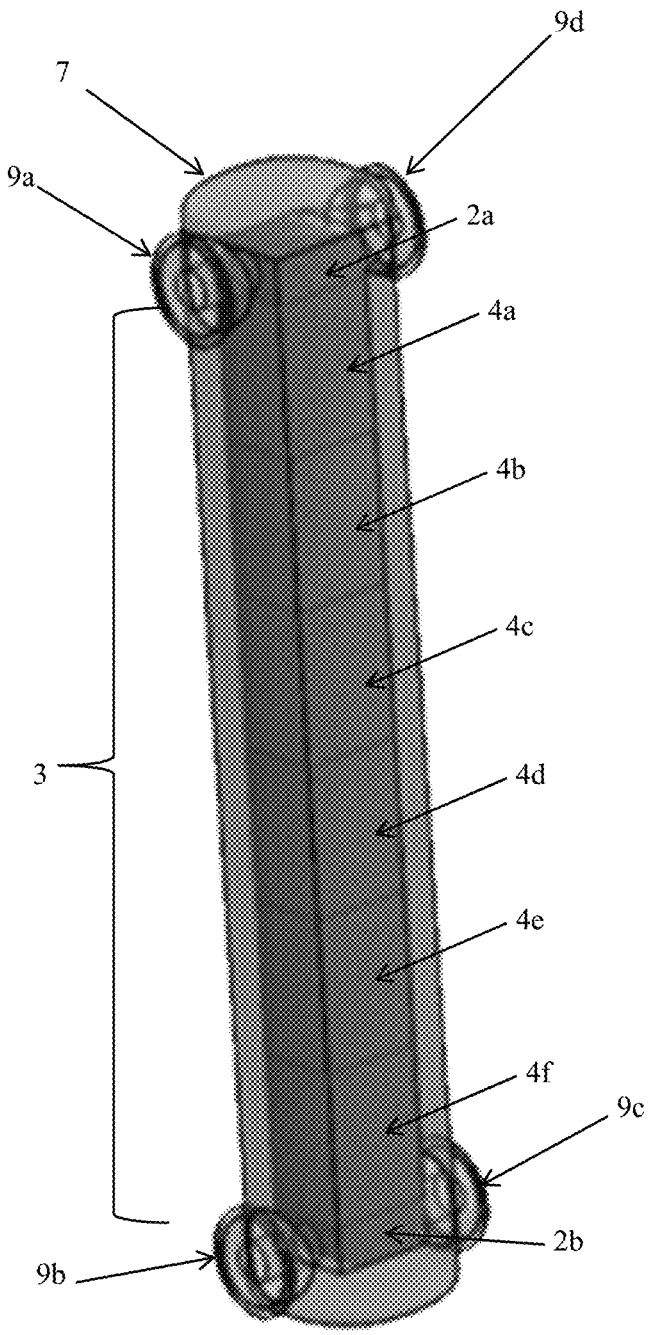
FIG. 7 depicts a perspective view of a heat exchanger including a housing or shell.

It has previously been described that fluid within a channel in a manifold 2 is isolated from fluid in other channels in that manifold 2, and that fluid within a channel in a heat exchange block 4 is isolated from fluid in other channels in that heat exchange block 4. To minimise the possibility of fluid leaking from the channels at a join between blocks 4 or between the block 4 and the manifold 2, a heat exchanger may be placed within a shell or housing. Such an arrangement is shown in FIG. 7, in which two manifolds 2*a*, 2*b* and a heat exchange stack 3 are enclosed in a housing (or shell) 7.

The internal dimensions of the housing 7 are similar to the outer dimensions of the combination of two manifolds 2 and the heat exchange stack 3 along the axis of the heat exchanger 1. When the manifolds 2*a*, 2*b* and heat exchange stack 3 are disposed within the housing 7, the housing 7 compresses the manifolds 2*a*, 2*b* and the heat exchange stack 3 along the axis. Compressing the elements of the heat exchanger 1 in this manner prevents fluid from leaving a fluid path at the join between two elements (i.e. a manifold 2 to heat exchanger block 4 join or a heat exchanger block 4 to heat exchanger block 4 join). In turn, this prevents contamination of a fluid travelling through the first set of fluid paths by a fluid travelling through the second set of fluid paths.

The housing 7 includes ports 9*a*, 9*b*, 9*c*, 9*d* that act as a connection between a fluid source and the manifolds 2*a*, 2*b*. For example, a first port 9*a* associated with the first manifold 2*a* and a first fluid path connects to a first fluid source, and a second port 9*b* associated with the second manifold 2*b* and a second fluid path connects to a second fluid source. In some aspects, a third port 9*c* associated with the second manifold 2*b* and the second fluid path also connects to the second fluid source 10.

Preferably, the housing 7 is a refractory lined steel housing and the heat exchange blocks 4 are held in place by fixtures within the lining. It will be apparent to the skilled person that the housing may be made of another material of sufficient strength.

It has been noted above that although the heat exchanger 1 can be made of any suitable material, the preferred material for manufacturing the manifolds 2 and the heat exchange stack 3 is Silicon Carbide (SiC) or a SiC derived material. This material provides a number of benefits over a conventional metal heat exchanger in terms of operating temperature, corrosion resistance, erosion resistance, and maintenance.

In terms of operating temperature and corrosion resistance, for example, typical material limits for specialist metals such as 253MA or Incolnel based alloys is limited to below 1000° C. when the environment is highly aggressive. With a SiC or SiC derived material, the heat exchanger may be operated continuously in highly corrosive and aggressive environments at up to 1350° C. By changing the variants of the SiC this can be increased to 1600° C. To further minimise the negative effects in the highly corrosive and aggressive environments, operation of the heat exchanger may be limited to 1070° C. In some aspects, therefore, the heat exchanger and, hence, the manifold operates between 1070° C. and 1350° C. In some aspects, the heat exchanger between 1070° C. and 1600° C. The higher operating temperature allows the heat exchanger to be applied to a wider variety of systems that require a heat exchanger.

In terms of erosion resistance, if solids are present in the flow, then erosion becomes an issue especially if the flow shape contains stagnation points. Furthermore, in order to manage thermal expansion issues the surfaces must be thin-walled, depleting their ability to withstand continuous solid impact. Use of SiC or a SiC derived material, however, allows greater erosion resistance. In turn, this improves the durability of the heat exchanger elements 2, 3 and reduces the amount of time required for maintenance.

Further, if there is build-up of material within the heat exchanger 1 (for example, tars may build up if hydrocarbons are present in one or both fluids), cleaning will be required. To clean the preferred heat exchanger 1, means of adding a sorbent media may be provided. Sorbent media acts as a 'sand-blasting' agent within the heat exchanger 1. The sorbent media is introduced into the flow stream, where the velocities are maintained consistently high due to the channel geometry, and is carried into the channels. The sorbent media therefore removes fouling from the interior walls through abrasive action. Cleaning in this manner is possible due to the material properties, and particularly the hardness, of SiC material. Typically, the sorbent media is typically alumina sand, which is recovered and re-used.

The cost of metallic heat exchangers is also prohibitive due to the elevated cost of Incolnel based alloys.

Examples of Use

Figure 8:
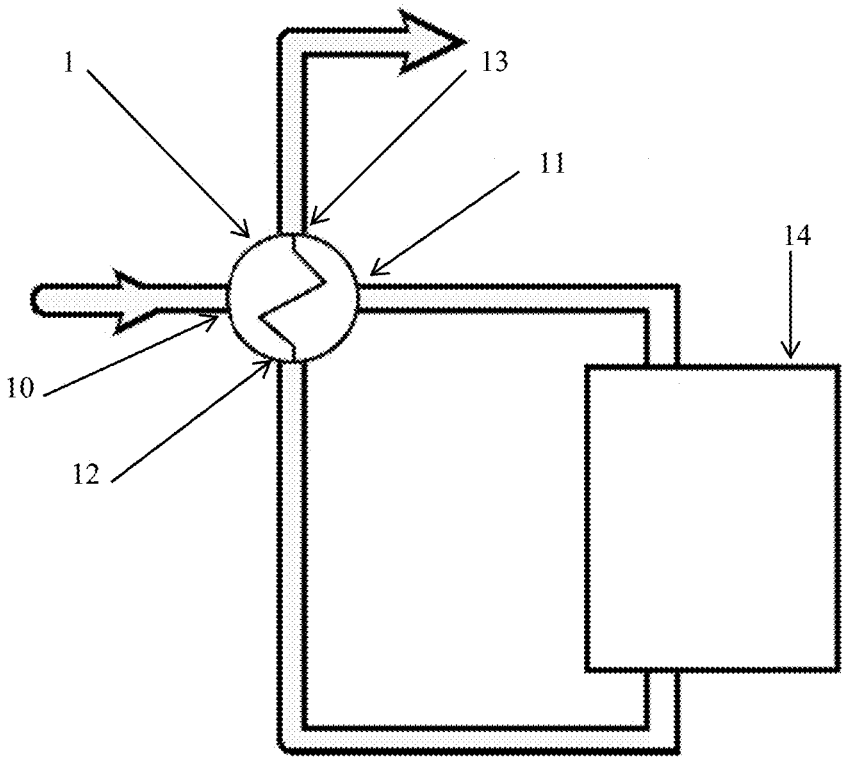
FIG. 8 depicts a schematic view of an Advanced Thermal Treatment system including a heat exchanger.
Figure 9:
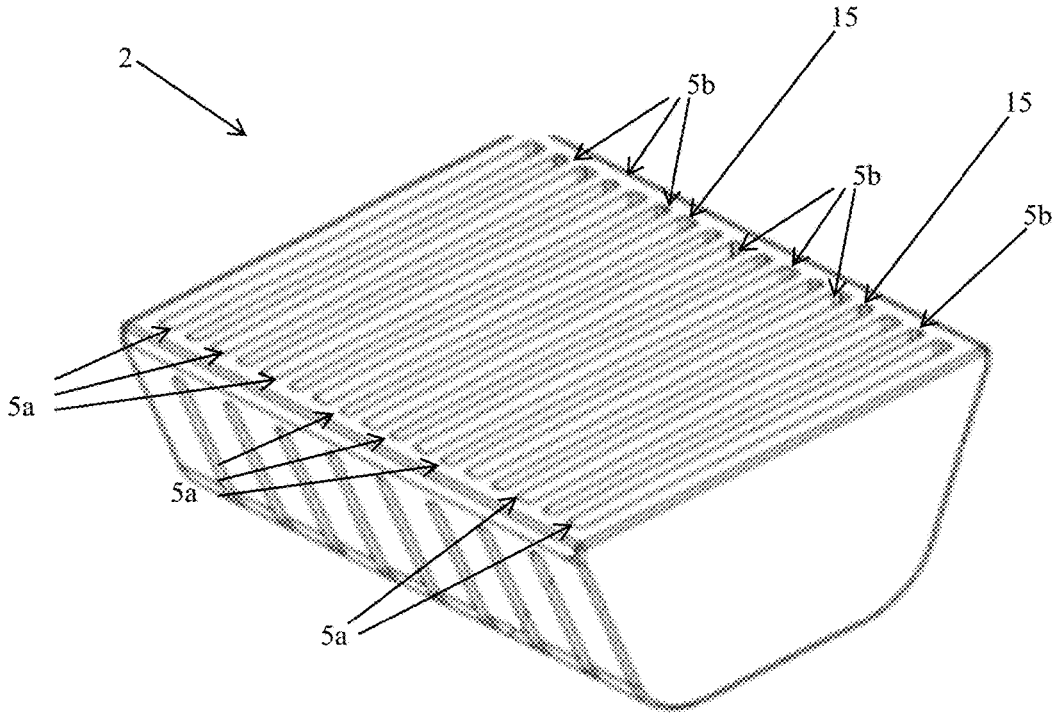
FIG. 9 depicts a perspective view of a manifold for a heat exchanger.

In one example, a heat exchanger 1 as described above can be implemented in an Advanced Thermal Treatment system. As shown in FIG. 8, for example, relatively cool gas from a first gas source enters the heat exchanger 1 at a first entrance (or first connector) 10, and flows toward a first exit (or third connector) 11. After the first exit 11, the gas enters an Advanced Thermal Treatment device 14, where the gas is heated during treatment. Upon exiting the Advanced Thermal Treatment device 14, the heated gas is re-introduced into the heat exchanger 1 at a second entrance (or second connector) 12 and flows toward a second exit (or fourth connector) 13. From the point of view of the heat exchanger 1, the Advanced Thermal Treatment device 14 is a second gas source. Within the heat exchanger 1, the relatively cool gas from the first source flows in a first gas path (first fluid path), whereas the heated gas from the Advanced Thermal Treatment device flows in a second gas path (second fluid path), the second gas path being parallel and interleaved with the first gas path as described above.

Advantageously, this use of the heat exchanger 1 allows gas entering the Advanced Thermal Treatment device 14 to be pre-heated, thereby reducing the energy required to raise the gas to the relevant temperature for processing while also cooling the heated gas from the Advanced Thermal Treatment device to allow it to be cleaned and processed.

When used in an Advanced Thermal Treatment system and where the manifold has a trapezoidal cross-section, a channel will have two openings; one along a non-parallel side of the trapezoid and one along a parallel side of the trapezoid. A first corner, about which gas will turn when the manifold is in use, therefore has openings on adjacent edges and a second corner has no openings on adjacent edges. In some aspects, the interior wall of the parallel side without an opening is slightly angled from the opening on a non-parallel side toward the second corner. Preferably, the angle between the outer wall of that parallel side and that interior wall is 40 and the interior wall is 295 mm long. The second corner has a radius of curvature of 110 mm, although a lower limit is 95 mm and an upper limit is 125 mm. Such a radius of curvature prevents fluid from stagnating at the second corner.

In another example, carbon black is produced from the partial oxidation of hydrocarbons including acetylene, natural gas and petroleum derived oil. The oxidation process consumes a proportion of the hydrocarbon to generate the heat required to sustain the carbon black production process. The higher the preheat temperature of the oxidant into the reactor (typically air) the higher the yield of the end-product. It is current practice to preheat the oxidant from the hot exhaust gas from the reactor utilise metallic or ceramic shell and tube heat exchangers for the application. The maximum preheat temperature of the air is limited by metallurgical considerations in the case of metallic heat exchangers where the peak air preheat is limited, including issues with corrosion and erosion (particularly when sulphur rich oils are used, for example). For current ceramic heat exchangers in the shell and tube configuration, the current limitations are due to the complexity in sealing the cold and hot gas streams from each other at every join between the tube and tubesheet. Additionally, oils contain ash products that deposit in the tubes, requiring regular maintenance stoppages. The heat exchanger here-in provides a means to achieve virtually limitless pre-heat level (within the pinch point of the heat exchanger) to provide a step change in process efficiency. Furthermore, the configuration allows for on-line cleaning to be adopted, mitigating downtime. More aggressive feedstocks containing higher sulphur levels or even selected plastic waste can be utilised for the process, improving process economics.

In yet another example, the heat exchanger 1 can be used to heat a closed loop air or thermal fluid to raise steam pressure and temperature in a safe, low cost, boiler thereby isolating boiler materials from the condensation of problematic (e.g. corrosive) chemicals. In conventional incinerators, recovery of energy is limited due to material corrosion. For example, thermal recovery keeps fluids below 570° C. due to condensation of problematic chemicals that corrode the boiler tubes. The above-described heat exchanger 1 minimises condensation due to having no stagnation points in the fluid path. Accordingly, problematic chemicals are less likely to build-up. Further, the preferred heat exchanger 1 is corrosion resistant to further limit the effects of any corrosive chemicals in the fluid flowing within the heat exchanger.

OTHER ASPECTS, EMBODIMENTS AND MODIFICATIONS

In some aspects, a manifold 2 may be adapted to allow the heat exchanger 1 to receive fluid from three or more fluid sources. This will give greater control over the temperature inside the heat exchanger and, hence, the temperature of the fluids exiting the heat exchanger. The manifold 2 according to this aspect will include three sets of channels 15*a*, 15*b*, 15*c* with each channel in those three sets having an opening in a first direction. The channels in the first set of channels 15*a* will also have an opening in a second direction, the channels in the second set of channels 15*b* will also have an opening in a third direction, and channels in the third set of channels 15*b* will also have an opening in a fourth direction.

When a manifold 2 allows a heat exchanger 1 to receive fluid from more than two fluid sources as set out above, different arrangements for the interleaved channels can be applied. For example, a channel in a third set of channels 15 may be disposed only after a predetermined number of interleaved channels from the first and second set of channels 5*a*, 5*b*—there may be N interleaved channels from each of the first and second set of channels 5*a*, 5*b* in between consecutive channels of the third set of channels 15, where N is a predetermined number. In some aspects, N is greater than one. The exact arrangement of channels can vary depending on the system to which the heat exchanger 1 is applied.

In an example where the heat exchanger 1 is used to pre-heat gas for processing in an Advanced Thermal Treatment system, the third gas source could be a heat source. For example, if the heated gas re-entering the heat exchanger 1 from the Advanced Thermal Treatment device 14 is not of sufficient temperature to preheat the gas that is about to enter the Advanced Thermal Treatment device 14, a dedicated heating fluid from the heat source may be passed through the heat exchanger to raise the temperature of the gases therein. Similarly, if the heated gas is not being cooled enough, a coolant may be employed in place of the dedicated heating fluid.

Of course, in an arrangement with four fluid sources (and the associated sets of channels in the manifolds and heat exchange blocks), both a dedicated heating fluid and a coolant may be employed. The manifold according to this aspect will include four sets of channels with each channel in those four sets having an opening in a first direction. The channels in the first set of channels will also have an opening in a second direction, the channels in the second set of channels will also have an opening in a third direction, channels in the third set of channels will also have an opening in a fourth direction, and channels in the fourth set of channels will also have an opening in a fifth direction, wherein the first to fifth directions are different from each other.

It will be appreciated that the present invention provides means to cause fluids from two different fluid sources to flow in a parallel direction in a heat exchanger.

It will be further appreciated that the present invention provides a heat exchanger comprising means to receive multiple fluid inputs and cause them to discreetly flow against one another in a parallel manner, and means to distribute said multiple fluids on exit from said heat exchanger. As previously discussed, the heat exchanger can allow either counter-current flow (i.e. anti-parallel fluid flow) or co-current flow (i.e. parallel fluid flow).

It will be still further appreciated that the present invention provides a parallel flow heat exchanger operable to receive a plurality of hot fluid sources and a singular relatively cold fluid source, such that heat is transferred from the hot fluids to the relatively cold fluid.

The invention claimed is:

1. A manifold for a parallel flow heat exchanger, the manifold comprising:

a first plurality of channels each extending through the manifold and having an opening facing a first direction and an opening facing a second direction different from the first direction, wherein the openings are on a surface of the manifold and wherein each of the first plurality of channels has a curvature between the opening facing the first direction and the opening facing the second direction;

a second plurality of channels interleaved with the first plurality of channels, each of the second plurality of channels extending through the manifold and having an opening facing a third direction and an opening facing the first direction, wherein the third direction is different from the first direction and the second direction, and wherein the openings are on a surface of the manifold and wherein each of the second plurality of channels has a curvature between the opening facing the third direction and the opening facing the first direction; and a third plurality of channels each having an opening facing a fourth direction and an opening facing the first direction, wherein the openings are on a surface of the manifold and wherein the fourth direction is different from the first direction, the second direction, and the third direction, wherein the first plurality of channels is attachable to a first fluid source, the second plurality of channels is attachable to a second fluid source different from the first fluid source, and the third plurality of channels is attachable to a third fluid source different from the first fluid source and the second fluid source, and each of the first plurality of channels is isolated from each of the second plurality of channels.

2. A manifold of claim 1, wherein the manifold is adapted to operate at a temperature between 1,070° C. and 1350° C.

3. A manifold of claim 1 wherein the manifold is Silicon Carbide or a Silicon Carbide derivative material.

4. A manifold of claim 1, wherein a predetermined number of interleaved channels from each of the first and second set of channels is disposed between consecutive channels from the third set of channels.

5. A manifold of claim 4, wherein the predetermined number is greater than one.

6. A manifold of claim 1, further comprising:

a fourth plurality of channels having an opening facing a fifth direction and an opening facing the first direction, wherein the fifth direction is different from the first direction, the second direction, the third direction, and the fourth direction.

7. A method of manufacturing the manifold of claim 1, comprising 3D printing said manifold.

8. A heat exchanger comprising two manifolds connected to opposed sides of a heat exchange stack, wherein:

each manifold is a manifold of claim 1; and the heat exchange stack comprises at least one heat exchange block, having a plurality of channels therethrough, the channels of the heat exchange block aligning with the channels of each manifold to form a series of gas paths encompassing both manifolds and the heat exchange stack.

9. A heat exchanger of claim 8, wherein each heat exchange block includes an inset area adapted to receive a gasket, said inset area being disposed on a surface of the block and surrounding the channels on the surface of the block.

10. A heat exchanger of claim 8, wherein a first fluid path comprises the first plurality of channels in a first manifold of the two manifolds and the first plurality of channels in a second manifold of the two manifolds and a second fluid path comprises the second plurality of channels in the first manifold of the two manifolds and the second plurality of channels in the second manifold of the two manifolds, the heat exchanger further comprising:

a first connector adapted to connect the first fluid path to the first fluid source; and a second connector adapted to connect the second fluid path to the second fluid source.

11. A heat exchanger of claim 10, further comprising a third connector to connect the first fluid path to the second fluid source at an end of the first fluid path opposed to the first connector.

12. A heat exchanger of claim 10, wherein the first and second connectors are both attached to the first manifold or to the second manifold.

13. A heat exchanger of claim 10, wherein the first connector is attached to the first manifold and the second connector is attached to the second manifold.

* * * * *